United States Patent [19]

Pelton et al.

[11] 4,313,790

[45] Feb. 2, 1982

[54] ADDITIVES FOR INCREASED RETENTION AND PITCH CONTROL IN PAPER MANUFACTURE

[75] Inventors: Robert H. Pelton; Lawrence H. Allen, both of Pointe Claire; Henry M. Nugent, Dollard des Ormeaux, all of Canada

[73] Assignee: Pulp and Paper Research Institute of Canada, Pointe Claire, Canada

[21] Appl. No.: 135,596

[22] Filed: Mar. 31, 1980

[51] Int. Cl.[3] ..... D21H 3/18

[52] U.S. Cl. ..... 162/163; 162/168 R; 162/183; 162/199; 162/DIG. 4

[58] Field of Search ..... 162/72, 158, 199, DIG. 4, 162/163, 168 R, 183; 260/124 R

[56] References Cited

U.S. PATENT DOCUMENTS 3,281,312 10/1966 Fetters et al. ..... 162/168 R
3,706,629 12/1972 Moore et al. ..... 162/168 R

FOREIGN PATENT DOCUMENTS 477209 10/1975 U.S.S.R. ..... 162/163

OTHER PUBLICATIONS

Casey, *Pulp and Paper,* vol. II, (1960), pp. 1093–1097.

*Primary Examiner*—Peter Chin
*Attorney, Agent, or Firm*—Lawrence I. Field

[57] ABSTRACT

A process is disclosed for the production of paper and paper-like products which consists of the addition to the papermaking furnish of kraft lignin or modified kraft lignin and poly(oxyethylene).

15 Claims, No Drawings

ADDITIVES FOR INCREASED RETENTION AND PITCH CONTROL IN PAPER MANUFACTURE

BACKGROUND OF THE INVENTION

1. Field of the Invention

The present invention relates to a process for increasing the retention of fines, fillers and pigments during the manufacture of paper while at the same time decreasing pitch deposition on the paper machine.

2. Description of the Prior Art

In the papermaking process much of the water in the pulp is separated from the fibres, fillers and pigments by filtration. The filtrate, which is called white water, contains a large amount of fines which may be fibre fragments, mineral fillers, or pigment particles. The poor retention of fines is a consequence of the difficulty in the filtration of material characterized by colloidal or nearly colloidal dimensions. Poor fines retention is a serious problem because it results in the loss of valuable material, additional loading of water treatment facilites, and possibly drainage problems on the paper machine. Retention problems in the manufacture of fine papers have been alleviated, in part, by the use of polymeric flocculants which are called retention aids. However, other grades of paper and, in particular, newsprint and groundwood specialties are characterized by poor fines retention and, in most cases, no economic benefit is gained by the use of existing retention aids. However, it is known from the teachings of U.S. Pat. No. 3,141,815 issued in July 21, 1964 to Manley, that poly(oxyethylene) can increase fines retention in certain commercial newsprint pulps. Still further, U.S. Pat. No. 4,070,236 to Carrard et al, issued Jan. 24, 1978, teaches that mixtures of poly(oxyethylene) and certain synthetic phenolic polymers will increase retention in paper making furnish based on mechanical pulp. However, the cost of the compounds involved is believed to be one reason why the process has not been widely commercially acceptable.

A second problem often associated with the manufacture of paper is the deposition of wood resin as pitch deposits on the surfaces of the process equipment. The term wood resin is used almost universally in the pulp and paper industry to denote the materials in wood and wood pulps which are insoluble in water and soluble in neutral organic solvents. Wood resin therefore includes terpenes, fatty and resin acids, esters, and various alcohols, hydrocarbons and neutral compounds associated with these materials. In aqueous wood pulp slurries the resin is present on the surfaces of the fibres (both in thin patches and droplets), inside parenchyma cells, as soluble soaps, and in the form of colloidal droplets dispersed in the process liquid among the fibres. The mechanisms by which this material deposits have been documented and the most troublesome physical form is usually the dispersed resin in newsprint manufacture. In the past, the most common methods for controlling pitch deposition have included the use of alum, dispersants, talc, sequestrants and a number of non-chemical methods.

SUMMARY OF THE INVENTION

A process has been discovered for the increase of fines retention and the decrease of pitch deposition during the manufacture of paper and it consists of the addition to the papermaking suspension of: (a) a lignin product, derived from the kraft pulping process, which may be chemically modified by sulfonation; and then (b) the addition of poly(oxyethylene) which is characterized by a molecular weight of $10^5$ or greater.

When the present invention is practiced with a newsprint or groundwood specialty furnish the retention of fines is increased which in turn results in decreased fines in the white water which facilitates a lower headbox consistency and a higher headbox freeness and thus increased drainage, better formation and a more even distribution of fines and filler in the sheet. Other benefits from increased fines retention include the possibility of lowering the energy consumption in the mechanical pulp mill and lower suspended solids effluents from the paper mill. In the cases where the installation of a high speed paper machine has resulted in an unacceptably high fines content in the white water system, the use of this invention would eliminate the need for a costly saveall or the transferal of white water to other paper or board machines better able to retain fines. In addition, practice of this invention results in a decrease in problems due to pitch deposition on the paper machine.

DETAILED DESCRIPTION OF THE INVENTION

The invention is applicable to newsprint, board and the so-called groundwood specialty pulp suspensions. Specifically, these systems include all paper and board furnishes based on mechanical pulp and, in part, semi-bleached kraft pulp, unbleached kraft pulp, and/or unbleached sulfite pulp. The mechanical pulp may be stone groundwood, thermomechanical pulp, or semi-chemical mechanical pulp. The kraft lignins used in the invention can be derived from the kraft pulping process and may be sulfonated, fractionated in terms of molecular weight, purified, and may be used either in the protonated or salt form. In practice, lignins characterised by a relatively high molecular weight and a relatively low degree of sulfonation are the most effective.

The poly(oxyethylene)s used in this invention are commercially available and are prepared by the polymerization of ethylene oxide. The average molecular weight of the poly(oxyethylene) should be above 100,000 and preferably near 10,000,000.

Kraft lignin products employed in the present invention are known to those skilled in the art. The lignin products are commercially available and as aforementioned, are derived from the kraft pulping process. Characterization of the product is somewhat difficult in the terms of chemical structure; however, the product per se is well known and is readily available. In the practice of the present invention, as aforementioned, it is desirable to employ a lignin product having at least a medium molecular weight with a relatively low degree of sulfonation. In practice, it has been found that as the molecular weight of the lignin product increases, the effectiveness in fines retention also increases. Similarly, those lignin products having a low degree of sulfonation have been found to be most effective. However, both of these properties are believed to be somewhat dependent on each other insofar as the manner in which the lignin product functions according to the invention. Thus, while a lower medium molecular weight lignin product having no sulfonation may be desirable, a low or medium molecular weight lignin product having a high degree of sulfonation is not desirable in the practice of the invention. Similarly, one may be able to employ a product having a medium degree of sulfonation if the molecular weight is very high. It will be understood that the terms "low, medium and high" are employed as they are utilized in the art. Thus, there is generally no definite molecular weight figures readily available for these products; they are characterized by the relative terms employed herein. The degree of sulfonation is generally based on the number of mols per 1000 unit weight of lignin. In this respect, a low degree of sulfonation may be generally defined as a product containing up to 1 mol of sulfonate groups per 1000 unit weight, a medium sulfonated product containing between 1 and 2 mols of sulfonate groups per 1000 unit weight, and a high degree of sulfonation being a product containing 2 or more mols of sulfonated groups per 1000 unit weight. In the practice of the present invention, it is generally preferred that the kraft lignin product have a degree of sulfonation below about 2.5 and it is more preferred that it have a degree of sulfonation between 0.0 and 1.5.

The kraft lignin product is added to the pulp slurry in an effective amount, with the poly(oxyethylene) to increase fines retention to the desired amount. The amount of kraft lignin product added to the slurry can vary depending on several factors—i.e. the amount of poly(oxyethylene), the molecular weight, the degree of sulfonation, etc. The amount can literally be determined by those skilled in the art for any particular product or process. However, in general terms, the kraft lignin product will be added at a rate of between 0.01 and 12 percent by weight based on the weight of oven-dried pulp; a preferred embodiment incorporates a range of between 0.1 percent and 5 percent by weight.

The poly(oxyethylene) will also be added in an effective amount depending on the parameters of the process. Again, in general terms, the amount may vary between 0.002 to 0.5 percent by weight based on the weight of oven-dried pulp with a preferred range being between 0.02 to 0.2 percent by weight. In general terms, in the commercial practice of the invention, it is desirable to minimize the amount of poly(oxyethylene) based on the commercial cost factors involved. However, the ratio, by weight, of poly(oxyethylene) to kraft lignin may vary between 5:1 to 1:200.

In the process of the invention, the poly(oxyethylene) is preferably added to the slurry as an aqueous solution before the stock reaches a papermachine headbox. Ideally the point of addition is sufficiently behind the headbox to enable complete mixing of the polymer in the pulp but after all points of extreme turbulence, such as fan pumps and pressure screens. A convenient method for poly(oxyethylene) addition consists of dissolving the polymer to form a one percent aqueous solution which is filtered and diluted by at least a factor of twenty prior to addition to the paper machine. The kraft lignin is desirably added at any point prior to poly(oxyethylene) addition which would enable complete mixing. Suitable locations include the intake to the fan pump or the thick stock proportioner. The kraft lignin should also be added as an aqueous solution.

In order to disclose more clearly the nature of the present invention the following examples illustrating the invention are given.

In each of the following Examples a Dynamic Drainage Jar was used for the measurement of retention. This apparatus is fully described in Pulp Paper Can., 80 (12):T425 (1979). It was fitted with a screen consisting of 86:65 plastic papermachine wire and a nozzle which was the tip of a 25 ml pipette.

EXAMPLE 1

A 0.025 percent poly(oxyethylene) solution was made by dissolving Nopcofloc* 310 in distilled water. Reax** 85A, a commercial kraft lignin derivative, was dissolved in water to give 0.175 or 0.05 percent solutions.

*Registered trade mark of Diamond Shamrock Corporation.
**Registered trade mark of Westvaco Corporation.

For this experiment pulp was collected from the headbox return line of a production paper machine. The stock was a letterpress furnish based on 26 percent low yield sulfite and 74 percent stone groundwood (45 percent balsam fir, 50 percent spruce and 5 percent jack pine). The pulp was stored at headbox consistency in 19-1 polyethylene containers at 5° C. Prior to use the pulp was successively centrifugated, decantated, and redispersed in distilled water.

To 250 g of newsprint headbox pulp at 50° C. was added 5 ml of 0.05% Reax** 85A solution. The mixture was gently stirred in a water bath at 50° C. A dilute poly(oxyethylene) solution was prepared by adding 2 ml of stock solution to 243 g of water at 50° C. and this was added to the pulp suspension. After two minutes stirring in the water bath, the pulp suspension was added to the Dynamic Retention Drainage Jar where it was stirred a further two minutes at 500 RPM, after which the valve was released and the white-water was collected in a beaker. The consistency (solids content) of the white-water was determined gravimetrically after filtration and drying of the filtered mat at 105° C. The first-pass retention was calculated by the following formula in which $C_I$ is the consistency of the pulp added to the Dynamic Retention Drainage Jar and $C_{WW}$ is the white water consistency.

$$\text{First-pass retention} = \frac{C_I - C_{WW}}{C_I} \times 100$$

The results for a series of polymer concentrations are summarized in Table I. In the absence of poly(oxyethylene) the Reax 85A did not increase fines retention and in the absence of the Reax 85A the poly(oxyethylene) did not increase fines retention. By contrast, the mixture of poly(oxyethylene) and Reax** 85A did increase the retention of fines in what appears to be a synergistic manner.

TABLE I

| POLYMER CONCENTRATION (percent based on oven-dried pulp) | | FIRST-PASS RETENTION |
|---|---|---|
| Nopcofloc* 310 | Reax** 85A | (percent) |
| 0 | 0 | 69.2 |
| 0.066 | 0 | 74.1 |
| 0.066 | 0.016 | 69.8 |
| 0.066 | 0.015 | 77.4 |
| 0.066 | 0.328 | 82.6 |
| 0.066 | 1.15 | 85.9 |
| 0.066 | 1.64 | 83.9 |
| 0.066 | 3.44 | 89.2 |
| 0.066 | 4.59 | 93.1 |
| 0.066 | 5.74 | 93.1 |
| 0.066 | 11.5 | 90.5 |
| 0 | 0 | 65.1 |
| 0.028 | 0 | 69.4 |
| 0.042 | 0 | 68.4 |
| 0.056 | 0 | 69.9 |
| 0.070 | 0 | 68.8 |
| 0.14 | 0 | 69.8 |
| 0.28 | 0 | 69.2 |
| 0.70 | 0 | 68.6 |
| 2.79 | 0 | 67.5 |

TABLE I-continued

| POLYMER CONCENTRATION (percent based on oven-dried pulp) | | FIRST-PASS RETENTION |
|---|---|---|
| Nopcofloc* 310 | Reax** 85A | (percent) |
| 0 | 0 | 68.6 |
| 0 | 0.031 | 68.9 |
| 0 | 0.077 | 68.8 |
| 0 | 0.155 | 68.8 |
| 0 | 0.232 | 68.9 |
| 0 | 0.387 | 69.8 |
| 0 | 0.775 | 69.3 |
| 0 | 1.55 | 69.6 |
| 0 | 3.10 | 70.0 |
| 0 | 8.05 | 68.3 |

EXAMPLE 2

In this example two commercial kraft lignins, Indulin C and Indulin AT were evaluated on a newsprint pulp furnish. The pulp and the experimental methods were as described in Example 1. The poly(oxyethylene) was #4031-2682 supplied by Polysciences and has a specified molecular weight of $5\times10^6$. The results, shown in Table II, indicate that both lignins will increase fines retention in newsprint when used in conjunction with high molecular weight PEO.

TABLE II

| POLYMER CONCENTRATION (percent based on oven-dried pulp) | | | FIRST-PASS RETENTION |
|---|---|---|---|
| Polysciences #4031-2682 | Indulin** C | Indulin** AT | (percent) |
| 0 | 0 | 0 | 64.4 |
| 0.06 | 0 | 0 | 68.8 |
| 0.06 | 0.016 | 0 | 71.5 |
| 0.06 | 0.11 | 0 | 74.9 |
| 0.06 | 1.10 | 0 | 77.5 |
| 0.06 | 1.58 | 0 | 78.3 |
| 0.06 | 10 | 0 | 91.6 |
| 0.06 | 0.63 | 0 | 82.5 |
| 0.06 | 2.36 | 0 | 73.9 |
| 0 | 0 | 0 | 66.0 |
| 0.06 | 0.017 | 0 | 71.3 |
| 0.06 | 0.052 | 0 | 73.8 |
| 0.06 | 0.012 | 0 | 74.4 |
| 0.06 | 0.26 | 0 | 79.7 |
| 0.06 | 0.69 | 0 | 82.4 |
| 0.06 | 1.21 | 0 | 82.0 |
| 0.06 | 2.6 | 0 | 81.1 |
| 0 | 0 | 0 | 62.4 |
| 0.06 | 12 | 0 | 91.1 |
| 0.06 | 0 | 0 | 73.1 |
| 0.06 | 0 | 0.017 | 70.2 |
| 0.06 | 0 | 0.115 | 75.1 |
| 0.06 | 0 | 0.331 | 82.7 |
| 0.06 | 0 | 1.16 | 81.5 |
| 0.06 | 0 | 1.65 | 85.0 |
| 0.06 | 0 | 12 | 93.8 |
| 0.06 | 0 | 0.50 | 89.4 |

EXAMPLE 3

The furnish used in this example was a so-called groundwood specialty stock based on 40 percent semi-bleached kraft and 60 percent stone groundwood. This paper was used as a coating base stock and the headbox pulp contained as much as 30 percent coated broke, thus introducing coating clay into the pulp. Clay and fibre retentions, measured with the Dynamic Retention Drainage Jar, are shown in Table III as a function of the concentration of added Nopcofloc* 310 and Reax** 85A. The two polymers increase clay and fibre retention in a synergistic manner.

TABLE III

| POLYMER CONCENTRATION (percent based on oven-dried pulp) | | FIRST-PASS RETENTION (percent) | |
|---|---|---|---|
| Nopcofloc* 310 | Reax** 85A | Clay | Fiber |
| 0 | 0 | 3.1 | 63.7 |
| 0.017 | 0.087 | 14.8 | 65.8 |
| 0.026 | 0.131 | 37.8 | 72.2 |
| 0.053 | 0.263 | 64.3 | 85.9 |
| 0.079 | 0.394 | 56.6 | 75.9 |
| 0.092 | 0.459 | 55.0 | 76.5 |
| 0.092 | 0.459 | 69.7 | 83.6 |
| 0.105 | 0.525 | 51.8 | 73.9 |
| 0.118 | 0.591 | 59.4 | 78.5 |
| 0.131 | 0.656 | 65.9 | 82.3 |
| 0.158 | 0.788 | 78.1 | 98.4 |
| 0.0161 | 0 | 3.4 | 66.4 |
| 0.0323 | 0 | 4.5 | 66.7 |
| 0.048 | 0 | 5.4 | 60.5 |
| 0.065 | 0 | 5.0 | 60.4 |
| 0.081 | 0 | 6.1 | 61.1 |
| 0 | 0 | 3.3 | 58.6 |
| 0 | 0.091 | 3.9 | 63.8 |
| 0 | 0.274 | 2.3 | 60.5 |
| 0 | 0.48 | 5.1 | 66.2 |
| 0 | 0.617 | 6.0 | 62.2 |
| 0 | 0.825 | 5.2 | 58.9 |

Handsheets were made from the same pulp with various amounts of the two polymers added and the physical properties of the paper were measured using standard CPPA and TAPPI procedures. The results, shown in Table IV, indicate decreased tear, breaking length, and stretch when polymer was added. This trend is consistent with increased clay content of the paper.

TABLE IV

| | | | | |
|---|---|---|---|---|
| Nopcofloc* 310, % | 0 | 0.017 | 0.026 | 0.079 |
| Reax** 85A, % | 0 | 0.087 | 0.131 | 0.394 |
| Grammage (Basis Wt.) $g \cdot m^{-2}$ | 60.5 | 55.7 | 57.4 | 54.4 |
| Bulking Caliper, μm | 113 | 105 | 106 | 98 |
| Bulk, $cm \cdot g^{-1}$ | 1.86 | 1.89 | 1.84 | 1.80 |
| Burst Index, $kPa \cdot m^2 \cdot g^{-1}$ | 2.34 | 2.10 | 2.06 | 2.00 |
| Tear Index, $mN \cdot m^2 \cdot g^{-1}$ | 7.41 | 7.43 | 7.05 | 6.70 |
| Breaking Length, km | 3.86 | 3.63 | 3.56 | 3.40 |
| ISO Brightness, 8–457, % Abs., WS | 63.7 | 63.6 | 62.8 | 62.8 |
| Visual Efficiency, 10-FMY/C, % | 68.9 | 68.7 | 68.1 | 68.3 |
| TAPPI Opacity, 10-FMY/C, % | 97.8 | 97.3 | 98.0 | 97.6 |
| Printing Opacity, 10-FMY/C, % | 98.6 | 98.4 | 98.8 | 98.5 |
| Scattering Coefficient, $cm^2 \cdot g^{-1}$ | 737 | 745 | 777 | 772 |
| Scattering Coefficient, $mm^{-1}$, 1–681 | 39.6 | 39.4 | 42.3 | 42.9 |
| Absorption Coefficient, $cm^2 \cdot g^{-1}$ | 16.3 | 17.0 | 19.4 | 18.0 |
| Absorption Coefficient, $mm^{-1}$ | 0.87 | 0.90 | 1.05 | 1.00 |

EXAMPLE 4

Nopcofloc* 310+Reax** 85A was evaluated as a fines retention aid in a commercial newsprint furnish. The pulp was collected from the headbox of a commercial paper machine and consisted of 30 percent sulfite and 70 percent stone groundwood. The wood species distribution was 79 percent spruce, 20 percent jack pine and 1 percent poplar. The pulp was not washed and the retention measurements were made in the manner described in Example 1. The results, tabulated in Table V, demonstrate the synergistic increase in retention upon addition of the two polymers.

TABLE V

| POLYMER CONCENTRATION (percent based on oven-dried pulp) | | FIRST-PASS RETENTION |
|---|---|---|
| Nopcofloc* 310 | Reax** 85A | (percent) |
| 0 | 0 | 67.4 |
| 0.012 | 0 | 69.6 |
| 0.024 | 0 | 70.1 |
| 0.036 | 0 | 72.5 |

TABLE V-continued

| POLYMER CONCENTRATION (percent based on oven-dried pulp) | | FIRST-PASS RETENTION |
|---|---|---|
| Nopcofloc* 310 | Reax** 85A | (percent) |
| 0.052 | 0 | 72.8 |
| 0.012 | 0.060 | 70.1 |
| 0.024 | 0.120 | 79.9 |
| 0.036 | 0.180 | 80.6 |
| 0.039 | 0.195 | 79.5 |
| 0.052 | 0.260 | 78.3 |
| 0.065 | 0.325 | 82.2 |
| 0 | 0.260 | 69.2 |
| 0 | 0.325 | 70.6 |

EXAMPLE 5

Illustrated in this example is the effect of poly(oxyethylene) plus kraft lignin on fines retention and dispersed resin particle concentration in the white-water. Another commercial newsprint headbox stock, based on 25 percent sulfite and 75 percent stone groundwood, was used. The wood species distribution of the pulp was approximately 60 percent spruce, 30 percent balsam fir, and 10 percent jack pine. Retention measurements were made with the Dynamic Drainage Jar and the results, shown in Table VI, again illustrate the synergistic effect the polymers have on fines retention.

TABLE VI

| POLYMER CONCENTRATION (percent based on oven-dried pulp) | | FIRST-PASS RETENTION |
|---|---|---|
| Nopcofloc* 310 | Reax** 85A | (percent) |
| 0 | 0 | 66.0 |
| 0.017 | 0 | 71.1 |
| 0.033 | 0 | 72.9 |
| 0.050 | 0 | 72.3 |
| 0.067 | 0 | 76.7 |
| 0 | 0.333 | 71.4 |
| 0.017 | 0.083 | 67.7 |
| 0.033 | 0.166 | 73.0 |
| 0.050 | 0.250 | 82.3 |
| 0.067 | 0.333 | 84.6 |

The concentration of colloidally dispersed wood resin in the Dynamic Drainage Jar white-water was determined by the method of Allen, L. H., Trans. Tech. Sect. CPPA, 3, 32 (1977). In this procedure the resin particle concentrations were determined with a hemacytometer and microscope which was fitted with a 40X objective lens and gave an overall magnification of 800X. The results are shown in Table VII as a function of the concentrations of the two polymers and at the highest polymer concentrations the dispersed resin in the white-water was reduced by a factor of 88. Clearly the poly(oxyethylene) (Nopcofloc* 310) was effective in removing resin on its own, however, its effectiveness was increased by the addition of the kraft lignin derivative.

TABLE VII

| POLYMER CONCENTRATION (percent based on oven-dried pulp) | | RESIN PARTICLE CONCENTRATION |
|---|---|---|
| Nopcofloc* 310 | Reax** 85A | (particles per $cm^3$ ($\times 10^{-6}$)) |
| 0 | 0 | 88 |
| 0.017 | 0 | 57 |
| 0.033 | 0 | 25 |
| 0.050 | 0 | 14 |
| 0.067 | 0 | 18 |
| 0 | 0.333 | 73 |
| 0.017 | 0.083 | 40 |
| 0.033 | 0.166 | 9 |
| 0.050 | 0.250 | 5 |
| 0.067 | 0.333 | 1 |

It will be understood that the above described embodiments are for the purpose of illustration only and changes and modifications may be made thereto without departing from the spirit and scope of the invention.

The embodiments of the invention in which an exclusive property or priviledge is claimed are defined as follows:

1. In a papermaking process utilizing an aqueous wood pulp slurry, the improvement which effects increasing the retention of fines, fillers and pigments while at the same time decreasing the deposition of pitch on the papermaking apparatus which improvement comprises: adding to the slurry an effective amount of a poly(oxyethylene) having a molecular weight of $10^5$ or greater and a kraft lignin product wherein the poly(oxyethylene) is added to the slurry at a rate of between 0.002 and 0.5 percent by weight and the kraft lignin product is added at a rate of between 0.01 and 12 percent by weight both rates being based on the weight of oven-dried pulp.

2. The improvement of claim 1, wherein said kraft lignin is at least a medium molecular weight lignin product having a degree of sulfonation below about 2.5.

3. The improvement of claim 1, wherein said kraft lignin is at least a medium molecular weight lignin product having a degree of sulfonation between 0.0 and 1.5.

4. The improvement of claim 1, 2 or 3, wherein the poly(oxyethylene) is added to the slurry as an aqueous solution.

5. The improvement of claim 1, 2 or 3, wherein the poly(oxyethylene) is added to the slurry as an aqueous solution before the slurry reaches a papermachine headbox, but after all points of extreme turbulence.

6. The improvement of claim 1, wherein the kraft lignin product is added as an aqueous solution to the wood pulp slurry.

7. The improvement of claim 1, 2, or 3 wherein both the poly(oxyethylene) and the kraft lignin product are added as aqueous solutions, the lignin product being added to the slurry prior to adding the poly(oxyethylene).

8. The improvement of claim 1, 2 or 3, wherein the poly(oxyethylene) has an average molecular weight of between $10^5$ and $10^7$.

9. The improvement of claim 1, 2 or 3, wherein the poly(oxyethylene) is added at a rate of between 0.02 to 0.2 percent by weight based on the weight of oven-dried pulp.

10. The improvement of claim 1, wherein the kraft lignin product is added to the slurry at a rate of between 0.1 and 5 percent by weight based on the weight of oven-dried pulp.

11. The improvement of claim 1, 2 or 3, wherein the poly(oxyethylene) is added to the slurry as an aqueous solution at a rate of between 0.02 and 0.2 percent by weight and the kraft lignin is added as an aqueous solution at a rate of between 0.1 and 5 percent by weight, both rates being based on the weight of oven-dried pulp.

12. The improvement of claim 1, wherein the ratio by weight, of poly(oxyethylene) to kraft lignin is between 5:1 and 1:200.

13. A method of increasing fines retention and decreasing pitch deposition on a papermaking machine in a papermaking process, said method comprising the steps of initially adding to an aqueous wood pulp slurry an effective amount of an aqueous kraft lignin product solution wherein the kraft lignin product has a relatively high molecular weight and a relatively low degree of sulfonation and subsequently adding to the slurry an effective amount of an aqueous solution of poly(oxyethylene) having a molecular weight of $10^5$ or greater, wherein the kraft lignin product is added at a rate of between 0.01 and 12 percent by weight and the poly(oxyethylene) is added at a rate of between 0.002 and 0.5 percent by weight, both rates being based on the weight of oven-dried pulp.

14. The improvement of claim 1, wherein the poly(oxyethylene) is added at a rate of between 0.02 to 0.1 percent based on the weight of oven-dried pulp.

15. The improvement of claim 13 or 14, wherein the kraft lignin product is added to the slurry at a rate of between 0.1 and 1.5 percent by weight based on the weight of oven-dried pulp.

* * * * *